United States Patent [19]

Waldrop et al.

[11] 4,160,676

[45] Jul. 10, 1979

[54] METHOD OF FORMING A COMPOSITE ROD

[75] Inventors: Walter I. Waldrop, P.O. Box 19042, Houston, Tex. 77024; Roy Waldrop; Cyrus Paul, both of Houston, Tex.

[73] Assignee: Walter I. Waldrop, Houston, Tex.

[21] Appl. No.: 934,393

[22] Filed: Aug. 17, 1978

[51] Int. Cl.[2] ..... B22D 23/06; B22D 19/02; B08B 7/00

[52] U.S. Cl. ..... 134/6; 134/29; 164/80; 164/97; 164/102; 164/105; 75/204

[58] Field of Search ..... 164/91, 97, 98, 99, 164/100, 101, 102, 103, 104, 105, 108, 71, 77, 80; 75/204, 203; 134/6, 29

[56] References Cited

U.S. PATENT DOCUMENTS

| | | | |
|---|---|---|---|
| 2,970,065 | 1/1961 | Greene | 164/103 |
| 3,028,644 | 4/1962 | Waldrop | 164/97 |
| 3,258,817 | 7/1966 | Smiley | 164/97 |
| 3,941,181 | 3/1976 | Stoody | 164/97 X |

FOREIGN PATENT DOCUMENTS

| | | | |
|---|---|---|---|
| 447219 | 12/1974 | U.S.S.R. | 164/91 |

*Primary Examiner*—Robert D. Baldwin
*Assistant Examiner*—K. Y. Lin
*Attorney, Agent, or Firm*—Jack W. Hayden

[57] ABSTRACT

A method of forming a composite rod having tungsten carbide particles embedded in a matrix comprising the steps of washing the tungsten carbide particles, placing a predetermined quantity of the carbide particles in a graphite mold, heating the mold and the carbide particles to a range of about 300° to 500° F. and pouring a water solution of flux in the mold while maintaining the temperature whereby the water boils off and the flux coats the surfaces of the carbide particles, placing a matrix in the mold and applying a multi-flame heat to the mold and carbide particles while stirring the particles in the mold with a graphite rod to assist in intimate contact and bonding of the melted matrix with the carbide particles to form a composite rod. The composite rod is then boiled in a weak solution of sodium hydroxide, rinsed and polished by buffing with wire bristles.

14 Claims, No Drawings

METHOD OF FORMING A COMPOSITE ROD

SUMMARY OF THE INVENTION

The present invention is an improvement on the process of U.S. Pat. No. 3,028,644 and provides a method of increasing the quality and production rate of forming a composite rod. It has been found that by employing the process of the present invention certain disadvantages with the prior art, including that procedure disclosed in U.S. Pat. No. 3,028,644 are overcome.

For example, it has been found that by lowering the temperature to the range of 300°-500° F., the possibility of surface cracks in the carbide particles is substantially reduced if not completely eliminated, thus achieving a better product.

Also, by employing a graphite rod to stir the carbide particles in the heated mold as a multi-flame heat is applied thereto, assists in intimately commingling the matrix as it melts to effect bonding thereof with the carbide particles to form the composite rod without causing any impurities to be added to the composite rod by dissipation of the graphite rod. The composite rod is removed from the mold and boiled in a weak water solution of sodium hydroxide, for example about a 2.5% solution by weight of sodium hydroxide for about ten to twenty minutes. The composite rod is next rinsed in water which enables the burned flux and any impurities on the surface of the composite rod to be more readily removed by polishing. The sodium hydroxide solution may be in the range of about 0.1% to about 5% by weight of sodium hydroxide.

Yet another object of the present invention is to provide a method of forming a composite rod including a matrix with carbide particles therein whereby the carbide particles, by reason of the process, may be more readily applied to a surface when the composite rod is used. Also, the procedure of the present invention not only increases the quality of the composite rod, but increases the rate of production by about 500% to 600%.

DESCRIPTION OF THE PREFERRED EMBODIMENT

In forming the composite rod of the present invention sinterd tungsten carbide particles of the hardest steel cutting ability are employed. Various sizes of tungsten carbide particles may be employed in forming the composite rod, depending upon the application of the composite rod in industrial and commercial uses.

The tungsten carbide particles are washed in any suitable solution to remove any foreign matter therefrom and carbon tetrachloride or any other suitable cleaning solution may be employed.

After the tungsten carbide particles have been washed to remove impurities therefrom, they are placed in a mold of suitable size and shape. The molds may each contain a plurality of longitudinal grooves of a desired configuration to form a composite rod therein of desired length and size which conforms to the shape of the groove. A longitudinal groove having a generally concave surface is preferred so that when the carbide particles are placed therein there will be a void or space between the concave surface and the adjacent carbide particles to enable the liquid flux and subsequently the molten matrix to more readily flow around the carbide particles to assure complete tinning or bonding of the surfaces of the carbide particles.

The molds are formed of graphite, and at the beginning of the process they are initially heated to the range of about 300° to about 500° F. While the molds are in use the application of the heat in the manner hereinafter described to melt the matrix and effect intimate contact and bonding thereof with the carbide particles maintains the heat of the mold throughout their period of use. However, if, for any reason, the process is interrupted so that the molds become cool, it is desirable to again heat the molds to the temperature range mentioned hereinabove before completing the remainder of the procedure. It has been found that the temperature range of 300° to 500° F. is more desirable than a higher temperature range since the lower temperature reduces, if not completely eliminates, the possibility of surface cracks in the carbide particles which may occur at the higher temperatures.

As noted earlier, any suitable size of carbide particles may be employed in forming the composite rod and such size is normally determined by the end use to which the composite rod is to be put. It is desired that the matrix bond the carbide particles together, but not be in a sufficient quantity so as to interfere with enabling the carbide particles to be deposited on a metal surface when the composite rod is ultimately used.

For example, we have found that when the composite rod is to be formed of carbide particles of approximately $\frac{1}{4}''$ in size and smaller, the matrix to be employed in forming the composite rod may be obtained by using one 3/16" and one $\frac{1}{8}''$ matrix rod to form each separate composite rod. This enables the carbide particles to be properly bonded with the matrix in accordance with the present invention in a desired manner to form the composite rod, but does not interefere with the cutting ability of the carbide particles when they are applied to a surface in ultimate use.

After the carbide particles have been placed in the mold and the heat either initially raised to the range of 300° to 500° F., or after the particles have been placed in a heated mold, a water solution of flux is poured into the mold while maintaining the temperature in the range of about 300° to 500° F.

Any suitable flux may be employed and we prefer a flux that is water soluble and have found that when the water soluble flux is mixed in the ratio of three parts water to one part flux, it performs quite satisfactorily.

After the water in the water solution of flux has boiled off from the mold leaving the carbide particles coated with flux the matrix rods may be placed in each composite rod mold groove. Matrix rods having any suitable composition well known may be employed and that disclosed in U.S. Pat. No. 3,028,644 functions quite satisfactorily.

After the matrix rods have been placed on the carbide particles in each of the molds, the matrix is then melted by applying a multi-flame heat to the matrix and carbide particles while simultaneously stirring the particles in the mold with a graphite rod to assist in intimate contact and commingling of the particles with the matrix to effect bonding of the matrix with the carbide particles as the matrix melts to form the composite rod with the carbide particles therein. Stirring with a graphite rod agitates the particles as the matrix is melted, but does not add any impurities to the matrix as the matrix is melted since it burns off into the atmosphere.

We have found that by using an oxy-acetylene torch with a rose bud tip or a large multi-flame tip, this provides an open multi-flame which distributes the heat to the mold, carbide particles and matrix over a somewhat larger area and maintains such larger area heated more uniformly as the matrix is melted and flows around each of the carbide particles to tin or bond them together. Also, since a plurality of flames are employed, this appears to minimize the danger of overheating the particles which may occur by holding or directing a single flame torch in one area too long to effect melting of the matrix. Such procedure also greatly enhances the quality of the finished product and provides a composite rod which, when employed enables the tungsten carbide particles to be applied to a desired surface and retained in position on such surface while exposing more cutting edges of each carbide particle.

Also, as the multi-flame heat is applied to the flux coated carbide particles and matrix in the grooves in the mold, it should be applied in a manner so that the heat and flames are directed downwardly toward the groove so that the flames penetrate to the bottom of the groove and assist in agitation of the carbide particles as the matrix melts further intimately commingling the matrix and carbide particles. Generally speaking the angle of the torch will be slightly off vertical approximately 10° to 25° to accomplish such results. Also, we have discovered that by moving the torch in a semicircle or arc back and forth across the mold groove as the flames move longitudinally therealong further improves the tinning or bonding of the matrix alloy and tungsten carbide particles by causing the molten matrix to be forced or assisted by the pressure of the flame into all areas of the mold thereby tinning or bonding more readily with the exposed surfaces of the tungsten carbide particles.

After the matrix has been melted and bonded with the carbide particles in each mold groove to form a composite rod, the composite rods are removed from the mold grooves and then boiled in a weak solution of sodium hydroxide. As a practical matter, a group of rods may be collected and boiled simultaneously, such as by way of example, 150 pounds of composite rods may be collected, placed on a rack and then submerged in a water solution of sodium hydroxide of approximately 2½% and boiled for approximately ten to twenty minutes to enable burned flux and other impurities which may be on the completed composite rod to be more readily removed. The composite rods are then rinsed with water and are polished or buffed, preferably by rotating wire brushes. The polishing, for unexplained reasons, seems to enable the carbide particles to better bond on a metal surface when the composite rod is subsequently used.

The foregoing disclosure and description of the invention are illustrative and explanatory thereof, and various changes in the size, shape, and materials as well as in the details of the illustrated construction may be made without departing from the spirit of the invention.

We claim:

1. A method of forming a composite rod having a matrix bonding tungsten carbide particles comprising the steps of:

a. washing the tungsten carbide particles;
b. placing a quantity of the carbide particles in a graphite mold;
c. heating the mold and particles to a range of about 300° to about 500° F. and pouring a water solution of flux in the mold while maintaining the temperature in the range of about 300° to about 500° F. whereby the water boils off and the flux coats the surfaces of the carbide particles;
d. placing a matrix in the mold; and
e. applying multi-flames to the mold and carbide particles while stirring the particles in the mold with a graphite rod to assist in intimate contact and commingling of the carbide particles and matrix to effect bonding of the matrix with the carbide particles to form the composite rod.

2. The method of claim 1 wherein the applied multi-flames are moved along the carbide particles and matrix in the mold as the matrix melts to maintain heat in the mold, carbide particles and matrix and assit in commingling and bonding of the matrix with the carbide particles to form the composite rod.

3. The method of claim 1 including the steps of:
a. removing the composite rod from the mold;
b. boiling the composite rod in weak solution of sodium hydroxide for about ten to twenty minutes; and
c. rinsing the composite rod in water.

4. The method of claim 1, including the step of polishing the composite rod.

5. The method of claim 4 wherein the polishing is effected by buffing the composite rod with wire bristles.

6. The method of claim 1, wherein the carbide particles are ¼" and smaller and wherein the matrix is formed by using one 3/16" and one ⅛" rod in the mold.

7. The invention of claim 3 wherein the sodium hydroxide solution is in the range of about 1% to about 5% by weight of sodium hydroxide.

8. The method of claim 2 including the steps of:
a. removing the composite rod from the mold;
b. boiling the composite rod in weak solution of sodium hydroxide for about ten to twenty minutes; and
c. rinsing the composite rod in water.

9. The method of claim 2 including the step of polishing the composite rod.

10. The method of claim 3 including the step of polishing the composite rod.

11. The method of claim 2 wherein the carbide particles are ¼" and smaller and wherein the matrix is formed by using one 3/16" and one ⅛" rod in the mold.

12. The method of claim 3 wherein the carbide particles are ¼" and smaller and wherein the matrix is formed by using one 3/16" and one ⅛" rod in the mold.

13. The method of claim 4 wherein the carbide particles are ¼" and smaller and wherein the matrix is formed by using one 3/16" and one ⅛" rod in the mold.

14. The method of claim 5 wherein the carbide particles are ¼" and smaller and wherein the matrix is formed by using one 3/16" and one ⅛" rod in the mold.

* * * * *